US006047675A

United States Patent [19]

Kunz

[11] Patent Number: 6,047,675

[45] Date of Patent: Apr. 11, 2000

[54] RETAINER CLIP AND VALVE ACTUATOR SUBASSEMBLY

[75] Inventor: Timothy Wilton Kunz, Rochester, N.Y.

[73] Assignee: General Motors Corporation, Detroit, Mich.

[21] Appl. No.: 09/189,873

[22] Filed: Nov. 10, 1998

[51] Int. Cl.[7] ..... F01L 1/18; F01L 1/46

[52] U.S. Cl. ..... 123/90.41; 123/90.43; 140/82

[58] Field of Search ..... 123/90.27, 90.39, 123/90.4, 90.41, 90.42, 90.43, 90.44, 90.45, 90.46, 90.61; 140/82

[56] References Cited

U.S. PATENT DOCUMENTS

| | | | |
|---|---|---|---|
| 3,139,872 | 7/1964 | Thompson | 123/90.41 |
| 3,166,058 | 1/1965 | Zink | 123/90.41 |
| 4,369,740 | 1/1983 | Seidl | 123/90.45 |
| 4,539,952 | 9/1985 | Nouno et al. | 123/90.36 |
| 4,539,953 | 9/1985 | Sasaki et al. | 123/90.41 |
| 4,598,674 | 7/1986 | Nono et al. | 123/90.41 |
| 4,676,203 | 6/1987 | Nouno | 123/90.42 |
| 5,211,143 | 5/1993 | Fontichiaro et al. | 123/90.18 |
| 5,775,280 | 7/1998 | Schmidt et al. | 123/90.41 |

*Primary Examiner*—Weilun Lo
*Attorney, Agent, or Firm*—Vincent A. Cichosz

[57] ABSTRACT

A valve actuator subassembly, such as a finger follower and a hydraulic lash adjuster or a rocker arm and push rod, are held together for shipping and installation in an engine valve train by a retainer clip made of wire or sheet, metal or plastic material. The retainer clip includes a U-shaped body having first and second nearly parallel legs interconnected at first ends by a resilient portion. The legs are adapted to resiliently engage opposite sides of a wall of a rockable actuator member having a raised portion on a first side aligned with a socket on a second side. The first leg includes a guide recess adjacent a second end and adapted to guidingly engage the raised portion on the first side of the wall. The second leg includes a gripping recess adjacent a second end and has a pair of opposed resilient edges adapted to frictionally grip nearly opposite sides of a cylindrical member, such as push rod or lash adjuster plunger, upon engagement of the cylindrical member with the socket in the wall of the actuator member. The resilient edges frictionally grip the cylindrical member at points nearly aligned on an axis normal to the directions of said legs from their first to their second ends so that the retainer clip frictionally retains said cylindrical member in the socket of the rockable actuator member in the subassembly positioned for installation in a valve train. Various embodiments are disclosed.

21 Claims, 5 Drawing Sheets

RETAINER CLIP AND VALVE ACTUATOR SUBASSEMBLY

TECHNICAL FIELD

This invention relates to valve actuator subassemblies, such as for use in the valve gear of internal combustion engines, and to retainer clips for holding together elements of a subassembly such as of a finger follower or rocker arm and a hydraulic lash adjuster plunger or pivot or a push rod.

BACKGROUND OF THE INVENTION

It is known in the art relating to automotive internal combustion piston engines of the overhead camshaft type to provide a subassembly of a pivot or hydraulic lash adjuster (HLA) having a cylindrical plunger with a finger follower that is rockable or pivotable about the pivot in engine operation. The subassembly may include a retainer clip for holding the finger follower in assembly with the lash adjuster or pivot for ease of installation of the subassembly into an engine. In prior subassemblies of this type, it has been common to provide a groove around the lash adjuster plunger to receive edges of an opening in a retainer clip applied to maintain the follower and adjuster in assembly. The groove allows rocking motion of the follower relative to the pivot or lash adjuster in an engine. However, it also makes a loose connection between the lash adjuster and the finger follower prior to assembly which requires extra care in assembly to locate the parts in proper orientation for assembly into an engine. Also, the reduced diameter at the groove reduces the bending stiffness and strength of the plunger as well as the volume of the internal oil reservoir.

SUMMARY OF THE INVENTION

The present invention provides an improved retainer clip concept for use in valve actuator subassemblies. The retainer clip has a U-shaped body with near parallel legs that clip over the end of a wall in the body of a finger follower or other valve element such as a rocker arm of an engine valve actuating mechanism. A first leg includes a guide recess that guidingly engages a raised portion on a first side of the wall. A second leg includes a gripping recess that engages diametrically opposite sides of a cylindrical member, such as the plunger of a hydraulic lash adjuster (HLA) or other component.

The gripping recess includes opposed resilient edges that frictionally engage the cylindrical surface of, for example, the HLA plunger and hold it in assembly with the finger follower without requiring a groove in the plunger to hold it in place. Instead, the frictional engagement of the resilient edges on the cylindrical surface is adequate to not only retain the parts together, but also to hold the HLA at a fixed angle to the finger follower that allows easy installation of the subassembly in an engine. Preferably, the resilient edges engage the cylindrical surface of the plunger at points near an axis normal to the plane of rocking of the finger follower, or other rockable actuator, and also normal to the direction of the legs of the retainer clip extending from the base of the U-shaped body to their distal ends. This feature insures that, in engine operation, the follower may rock relative to the HLA plunger, or other pivot, without causing bending and ultimate failure of the retainer clip in the engine.

In a preferred embodiment, the retainer clip is formed as a unitary member from a single piece of spring material. However, alternative sheet metal embodiments are also disclosed with alternative forms of gripping recesses. Optionally the legs of the retainer clip and the recesses in the legs are substantially identically configured to simplify manufacture, handling and assembly, allowing either leg of the clip to provide the gripping recess and avoiding the possibility of incorrect assembly. The recesses may be either closed-sided openings or open on one side with the opposed resilient edges formed as near parallel sides or inwardly protruding portions of the recesses. The retainer clips are preferably unitary members made of any suitable resilient metal or plastic material.

These and other features and advantages of the invention will be more fully understood from the following description of certain specific embodiments of the invention taken together with the accompanying drawings.

DESCRIPTION OF THE PREFERRED EMBODIMENT

Figure 1:
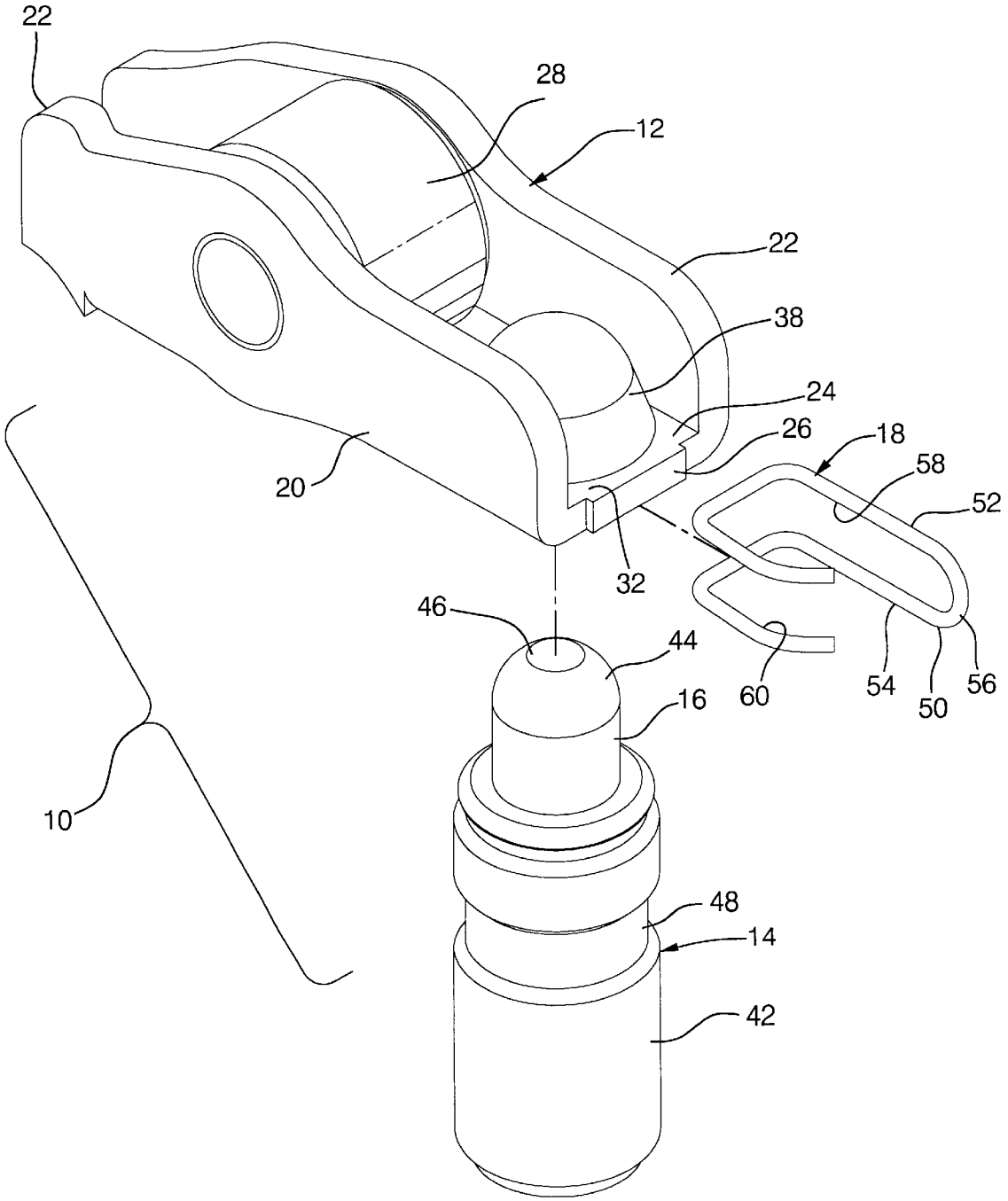
FIG. 1 is an exploded pictorial view of a valve actuator subassembly of a finger follower and a hydraulic lash adjuster connected by a retainer clip in accordance with the invention.
Figure 2:
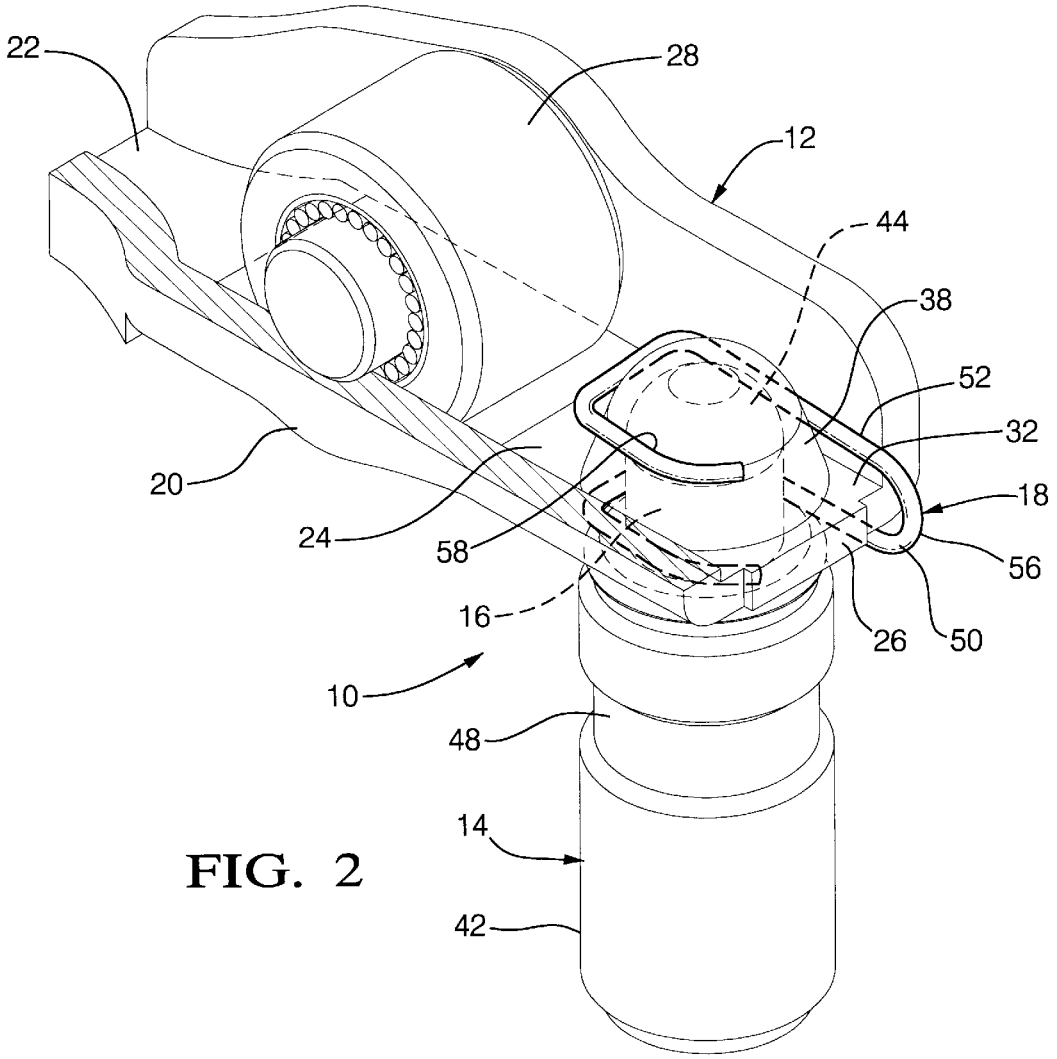
FIG. 2 is a pictorial view of the subassembly of FIG. 1 partially broken away to disclose certain details.
Figure 3:
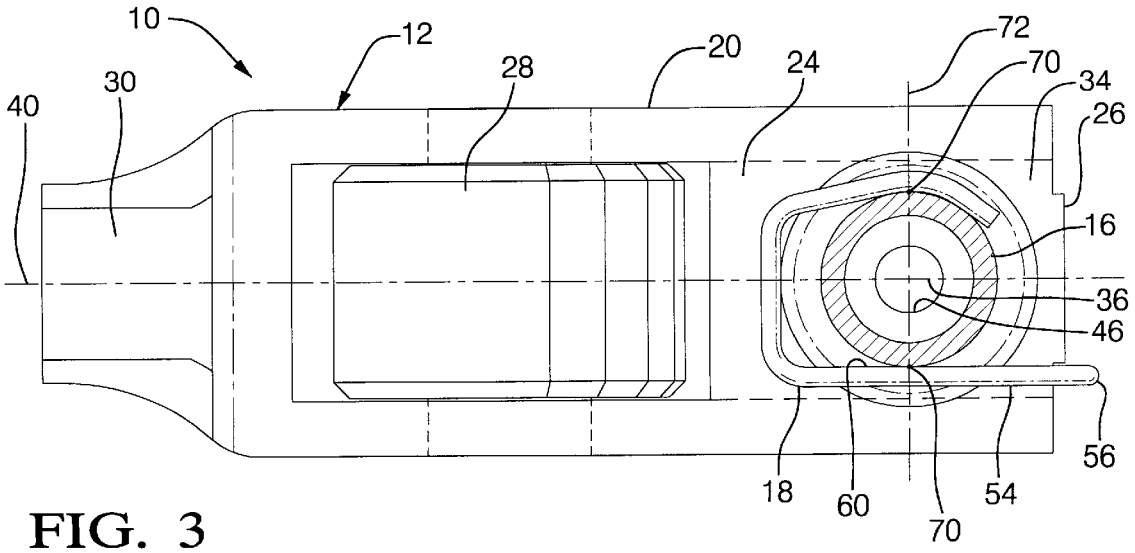
FIG. 3 is a cross-sectional bottom view of the subassembly of FIG. 2 with the lower portion of the lash adjuster plunger removed.
Figure 4:
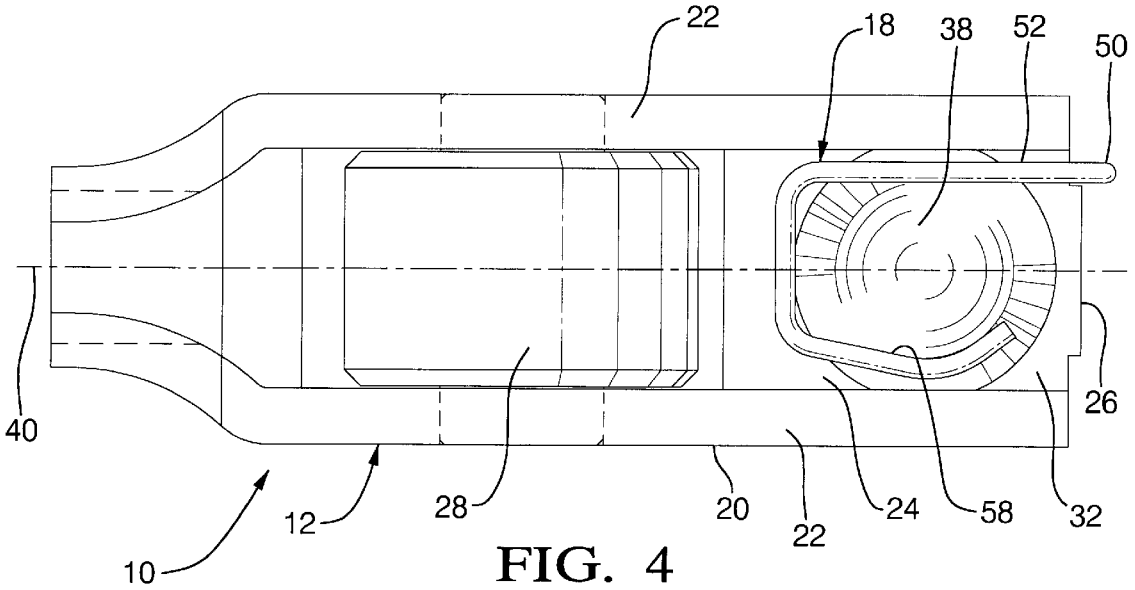
FIG. 4 is a top view of the subassembly of FIG. 2.
Figure 6:
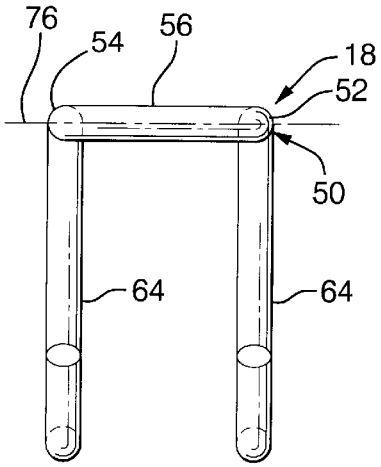
FIG. 6 is an outer end view of the retainer clip of FIG. 5
Figure 5:
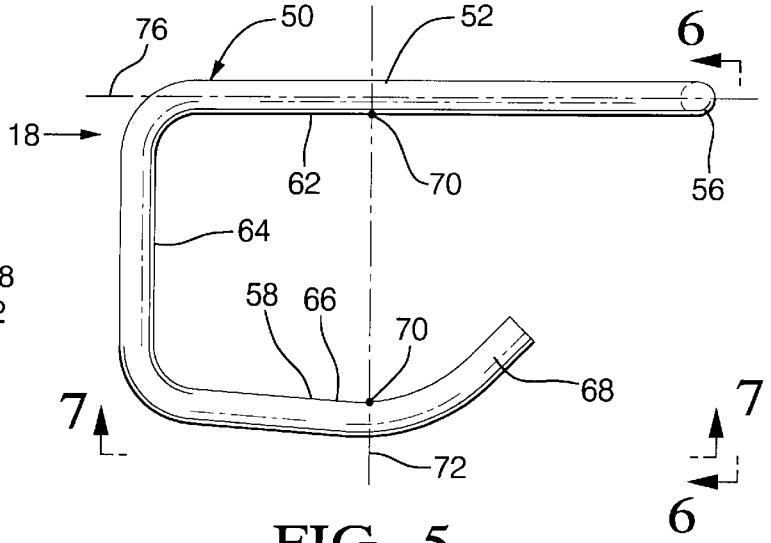
FIG. 5 is a top view of a retainer clip according to the invention.
Figure 7:
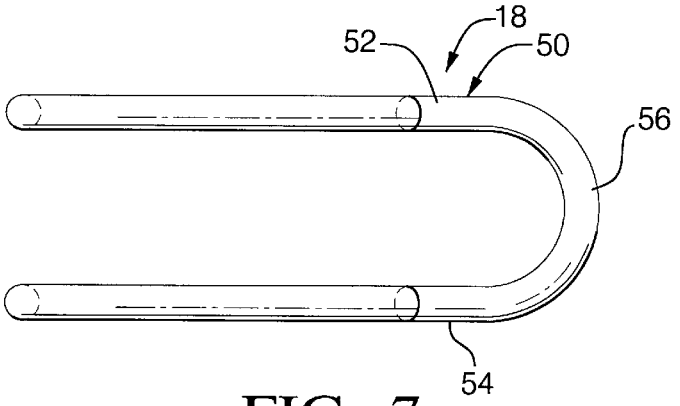
FIG. 7 is a side view of the retainer clip of FIG. 5.
Figure 8:
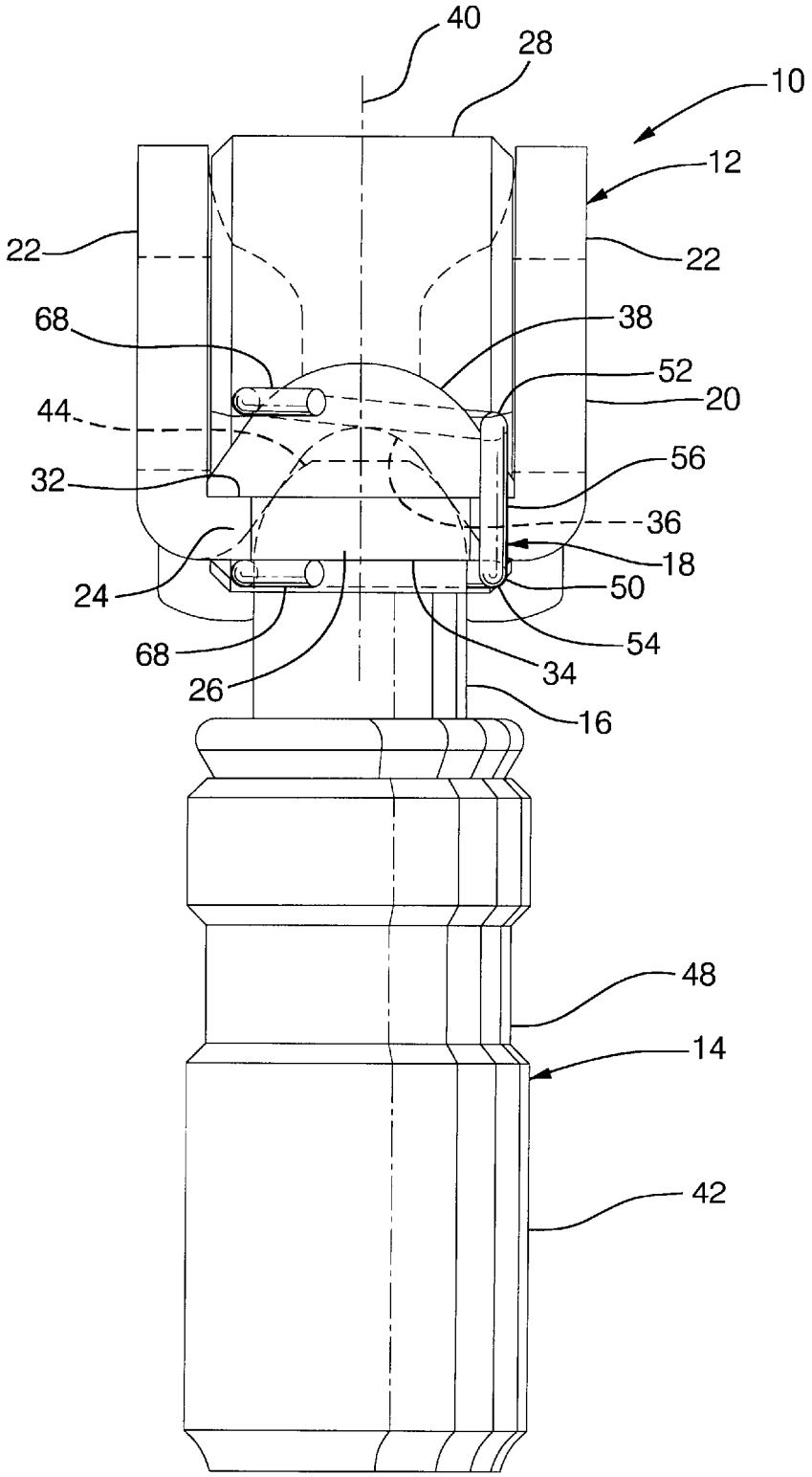
FIG. 8 is an outer end view of the subassembly of FIG. 2.

Referring first to FIGS. 1–8 of the drawings in detail, numeral 10 generally indicates a valve actuator subassembly including a rockable actuator member in the form of a finger follower 12, a hydraulic lash adjuster 14 having a cylindrical plunger 16, and a retainer clip 18 formed in accordance with the present invention. The clip 18 is provided to hold the HLA 14 and follower 12 together in the subassembly 10 with the elements 12, 14 fixed at a predetermined angular relation for ease of handling and subsequent assembly into the valve actuating mechanism of an automotive piston engine, not shown.

The finger follower is of a type used in overhead camshaft engines and includes a formed metal arm 20 having side walls 22 connected at opposite ends along their lower edges by a bottom wall 24 having an outer end 26. A cam follower roller 28 is carried between the side walls 22 and is engagable in use with a cam of an associated engine camshaft. At an inner end of the follower, the bottom wall forms a seat 30 for engaging an associated valve, not shown. The outer and inner portions of the bottom wall are separated to provide space for the roller and minimize the weight of the follower.

Adjacent the outer end 26, the bottom wall 24 has a first upper side 32 and a second lower side 34. The lower side 34 includes a socket 36 formed as a recess near the outer end 26 and adapted to receive a part spherical member therein. The upper side 32 is correspondingly deformed upward, forming a generally rounded raised portion 38 aligned with the socket 36 below. In use, the finger follower is rockable or pivotable about the center of the socket 36 in a rocking plane 40 passing through the centers of the socket 36 and the valve engaging seat 30.

The hydraulic lash adjuster (HLA) 14 includes a cylindrical body 42 from which projects the lash adjusting cylindrical plunger 16 having a part spherical end 44 including a central oil hole 46. The body 42 includes an annular groove 48 through which oil is received into the HLA for actuating the lash adjusting functions and supplying oil through the hole 46 of the plunger. It is noted that the plunger is not provided with an annular groove as are some prior plunger designs in order to provide for assembly with a retainer clip. Instead, the cylindrical outer surface is unbroken, resulting in a stronger plunger and larger internal oil reservoir due to the omission of an annular groove.

The retainer clip 18 of the illustrated embodiment is formed as an integral member from a single piece of spring wire, which is preferably metal but could possibly be made of a suitable plastic material. Clip 18 is formed as a U-shaped body 50 having first and second near parallel legs 52, 54, respectively. The legs are interconnected at first ends by a resilient connector portion 56. Each of the legs includes an identical recess which, for purposes of identification and differentiation, are called a guide recess 58 in the first leg 52 and a gripping recess 60 in the second leg 54. Both recesses are formed by bending second ends of the legs, distal from the connector portion 56, with two right angle bends and a smaller angle bend near each end of the wire. The recesses are thus defined by a first edge 62 formed by the extended wire of the respective leg, a connecting end 64 extending laterally relative to the first edge 62, a second edge 66 extending from the connecting end nearly parallel with the first edge 62, but preferably sloping slightly away from the first edge 62 in the direction away from the connecting end 64. An angular end 68 partially closes an inner side of each recess. Each recess 58, 60 is thus configured as a nearly or generally rectangular opening having a partially open end and nearly parallel opposed resilient edges 62, 66 that are slightly farther apart adjacent the angular end 68 and are resiliently yieldable by reason of their construction from spring wire.

In assembly with the finger follower 12 and HLA 14, the retainer clip 18 is forced over the outer end 26 of the bottom wall 24 of the finger follower 12 with the legs 52, 54 resiliently engaging the upper and lower sides 32, 34, respectively, of the bottom wall 24. The guide recess 58 of the upper first leg 52 engages and partially surrounds the raised portion 38 to guide the retainer clip into position with the gripping recess 60 below and aligned with the socket 36. The HLA may then be installed by pushing the plunger 16 through the gripping recess 60 and into the socket 36 where it is retained by the friction of the resilient first and second edges 62, 66 of the gripping recess opening 60. The slight slope of the edges 62, 66 positions the plunger adjacent to the angular end 68 of the clip so that interference of the plunger with the end 64 cannot occur. The spring wire is sized to provide adequate force to retain the clip on the bottom wall 24 until the HLA 14 is inserted and then to frictionally retain the plunger 16 in place in the socket 36 by the friction of the first and second resilient edges of the gripping recess 60 acting against the cylindrical exterior of the plunger, without need for an annular groove. The nearly parallel edges 62, 66 of the gripping recess 60 only contact the cylindrical diameter of plunger 16 at two nearly opposite points 70 which are aligned near an axis 72 normal to the rocking plane 40 of the finger follower 12. The axis 72 also lies normal to the plane 76 of the retainer clip legs 52, 54 as they extend from the connector portion 56 toward their distal ends, or from their first to their second ends.

Figure 9:
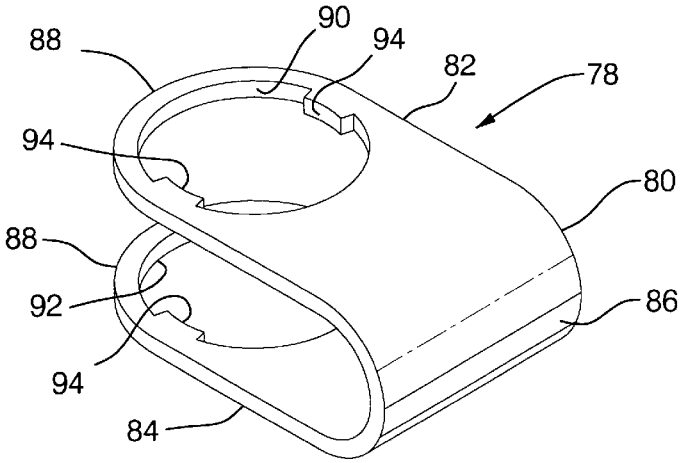
FIG. 9 is a pictorial view of an alternative embodiment of retainer clip according to the invention.
Figure 10:
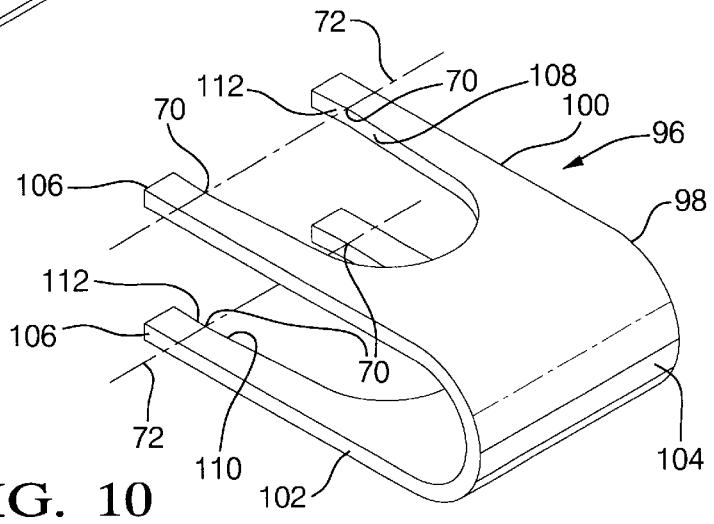
FIG. 10 is a pictorial view of another embodiment of retainer clip according to the invention.

FIGS. 9 and 10 show exemplary alternative embodiments of retainer clips formed from sheet metal or plastic and which could be substituted for the preferred wire retainer clip described above. Referring to FIG. 9, a retainer clip 78 is shown having a U-shaped body 80 formed of bent sheet metal with parallel legs 82, 84 extending from a connecting portion 86 to distal ends 88. Adjacent the distal ends are a guide recess 90 in first leg 82 and a gripping recess 92 in second leg 84. These recesses are identically formed for convenience and may consist of essentially round closed-sided openings adjacent the distal second ends of the legs 82, 84. The recess openings 90, 92 include inward projections 94 at points lying on or near an axis normal to the rocking plane 74 of the follower 12 and the plane 76 formed by the aligned edges of legs 82, 84. These projections 94 must be resilient and form the resilient edges required to frictionally grip the opposite points of an associated plunger of a HLA so as to hold it in place while allowing rocking motion of the finger follower without significant bending of the retainer clip during subsequent engine operation.

Referring to FIG. 10, a similar retainer clip 96 is shown having a U-shaped body 98 formed of bent sheet metal or plastic with generally parallel legs 100, 102 extending from a connecting portion 104 to distal ends 106. Adjacent the distal ends are a guide recess 108 in first leg 100 and a gripping recess 110 in second leg 102. These recesses are identically formed for convenience and consist of essentially open-sided openings adjacent and opening to the distal second ends of the legs 100, 102. The recess openings 108, 110 include inwardly opening nearly parallel resilient edges 112 engagable with points on a cylindrical plunger of a HLA, as before, lying on an axis 72 normal to the rocking plane 74 of the follower 12 and the plane 76 formed by the aligned edges of legs 100, 102. The resilient edges are preferably sloped slightly outward toward the points of intersection with the axis 72 and frictionally grip nearly opposite points of an associated plunger of a HLA so as to hold it in place while allowing rocking motion of the finger follower without substantial bending of the retainer clip during subsequent engine operation. If desired, the edges of the legs 100, 102 could be provided with resilient projections to contact the plunger as in the previously described embodiment of FIG. 9.

In the embodiments described, the guide recesses have been formed for convenience to be identical to the gripping recesses. This is not required for proper performance, since the guide recesses could as easily be made round or of any other shape which would properly coact with and guide on the raised portion of the bottom wall of the finger follower or other rockable actuator member. However, making the recesses identical is desirable as it allows the retainer clips to be installed on the rockable actuator member in either of two possible ways, with the first legs up or down, with the same result that the lower leg recess will act as a gripping recess and carry out the functions of the retainer clip as intended. Thus, the identically formed recesses avoid the possibility of assembly of the retainer clip in a wrong orientation and reduce the assembly cost by eliminating any requirement for a specific orientation of the clip.

Although the preferred embodiment described shows application of the invention to a subassembly of a finger follower and a HLA, other applications will readily be apparent. For example, retainer clips of the invention could also be used to connect an engine valve actuating rocker arm to a cylindrical push rod in the same manner as described above. Connection of a finger follower to a simple non-lash adjusting pivot would also be possible as would other combinations apparent to those skilled in the art.

Figure 11:
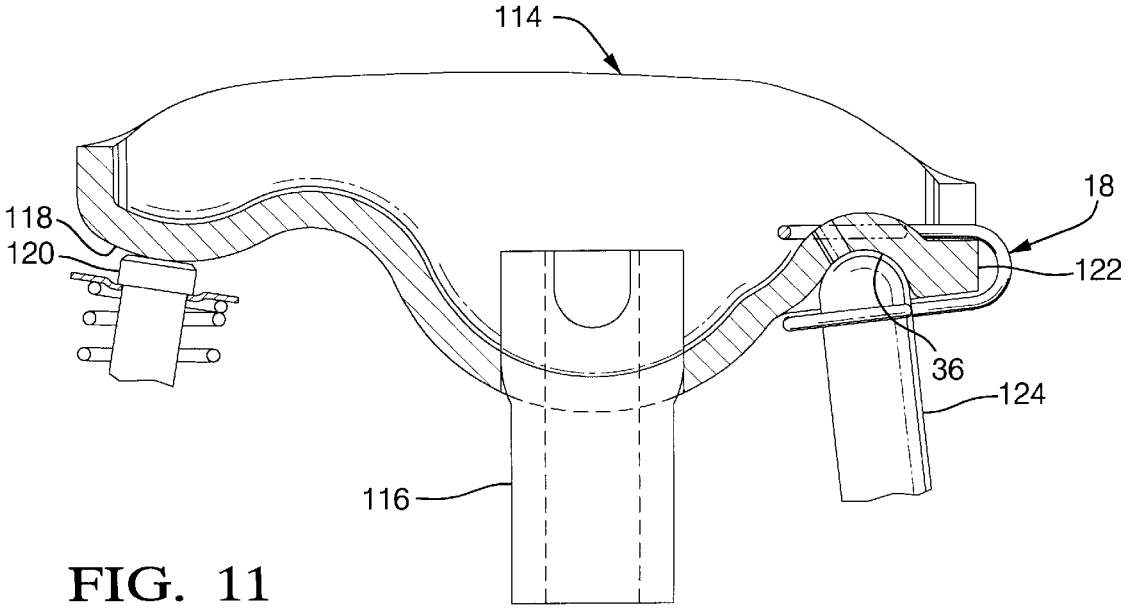
FIG. 11 is a cross-sectional view of an exemplary alternative embodiment of valve actuator subassembly of a rocker arm, push rod and retainer clip according to the invention.

As an example, FIG. 11 shows part of an engine valve train in which a rocker arm 114 pivotable on a pedestal 116 has one end with a seat 118 engaging the stem 120 of an engine valve. The other end 122 of the rocker arm is configured similarly to the finger follower of FIGS. 1–4 and 8 including a socket 36 in which a cam actuated push rod 124 is received. The push rod has a cylindrical end which is gripped by a retainer clip 18 that mounts on the end of the rocker arm and grips the push rod 124 to form a valve actuator subassembly. The push rod end of the rocker arm mounts the clip 18 and the clip grips the push rod in the same manner as the clip 18 on the finger follower 12 grips the lash adjuster plunger 16 and with the same advantages as previously described so that further description is believed unnecessary.

As used in the specification and claims, the terms "nearly parallel", "nearly aligned", "nearly opposite", and the like are intended to include the corresponding conditions of exactly parallel, aligned, opposite, and so forth.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A retainer clip for holding together members of a valve actuator subassembly, said clip comprising:

a U-shaped body having first and second generally parallel legs interconnected at first ends by a resilient portion, said legs adapted to resiliently engage opposite sides of a wall of a rockable actuator member;

said first leg including a guide recess adjacent a second end and adapted to guidingly engage a raised portion on a first side of said wall; and said second leg including a gripping recess adjacent a second end and having a pair of opposed resilient edges adapted to frictionally grip nearly opposite sides of a cylindrical member upon engagement of the cylindrical member with a socket in said wall, said socket aligned with said raised portion but on an opposite side of said wall and said resilient edges frictionally gripping said cylindrical member at points nearly aligned on an axis normal to the directions of said legs from their first to their second ends;

whereby said retainer clip is adapted to frictionally retain said cylindrical member in said socket of the rockable actuator member in a subassembly positioned for installation in a valve train.

2. A retainer clip as in claim 1 wherein said opposed resilient edges of the gripping recess in said second leg are configured to contact a minimal portion of the circumference of the cylindrical member.

3. A retainer clip as in claim 2 wherein said opposed resilient edges are nearly parallel to one another.

4. A retainer clip as in claim 2 wherein said opposed resilient edges comprise inward protrusions from opposite sides of said gripping recess.

5. A retainer clip as in claim 1 wherein said first leg including said guide recess is configured substantially identically to said second leg including said gripping recess.

6. A retainer clip as in claim 1 wherein said guide recess is formed as an opening with an at least one partially open side.

7. A retainer clip as in claim 1 wherein said guide recess is formed as a closed-sided opening.

8. A retainer clip as in claim 1 wherein said U-shaped body is formed as an integral member.

9. A retainer clip as in claim 8 wherein said integral member is formed of spring wire.

10. A retainer clip as in claim 9 wherein said integral member is formed of a resilient sheet material.

11. A valve actuator subassembly including:

a retainer clip as in claim 1;

a rockable actuator member; and a cylindrical member;

said actuator including a wall having an end and first and second sides extending from said end, said first side including a generally round raised portion adjacent said end and said second side including a socket aligned with said raised portion;

said cylindrical member including a cylindrical diameter and a rounded end received in said socket;

said retainer clip first leg engaging the first side of said wall and said second leg engaging the second side of the wall, the interconnection of said legs extending around said end of the wall;

said guide recess of the first leg guidingly receiving said round raised portion of the first side of the wall for locating the gripping recess of the second leg in alignment with the socket in the second side of the wall;

said opposed resilient edges of the gripping recess frictionally gripping nearly opposite sides of said cylindrical diameter at points nearly aligned on an axis normal to a plane of rocking of said rockable actuator to hold said rounded end in engagement with said socket of the actuator member wall.

12. A valve actuator subassembly as in claim 11 wherein said retainer clip is formed of spring wire and said gripping recess is formed by a bent end of said second leg having an inwardly open end and nearly parallel sides forming said opposed resilient edges.

13. A valve actuator subassembly as in claim 12 wherein said first leg including said guide recess is configured substantially identically to said second leg including said gripping recess.

14. A valve actuator subassembly as in claim 11 wherein said retainer clip is formed of resilient sheet material and said first leg including said guide recess is configured substantially identically to said second leg including said gripping recess.

15. A valve actuator subassembly as in claim 14 wherein said gripping recess is formed as an opening adjacent a second end of said second leg.

16. A valve actuator subassembly as in claim 15 wherein said opposed resilient edges are nearly parallel to one another.

17. A valve actuator subassembly as in claim 15 wherein said opposed resilient edges comprise inward protrusions from opposite sides of said gripping recess.

18. A valve actuator subassembly as in claim 15 wherein said first leg including said guide recess is configured substantially identically to said second leg including said gripping recess.

19. A valve actuator subassembly as in claim 11 wherein said rockable member is a finger follower and said cylindrical member is a pivot for rocking motion of the finger follower.

20. A valve actuator subassembly as in claim 19 wherein said pivot is a plunger of a hydraulic lash adjuster.

21. A valve actuator subassembly as in claim 11 wherein said rockable member is a rocker arm and said cylindrical member is a push rod.

* * * * *